US007270067B2

(12) United States Patent
Antonov et al.

(10) Patent No.: US 7,270,067 B2
(45) Date of Patent: Sep. 18, 2007

(54) WHEEL-CONTROLLED SAILS

(76) Inventors: Sergey Antonov, 1214-40 High Park Ave., Toronto (CA) M6P 2S1; Alexei I Antonov, 1604-40 High Park Ave., Toronto (CA) M6P 2S1

( * ) Notice: Subject to any disclaimer, the term of this patent is extended or adjusted under 35 U.S.C. 154(b) by 133 days.

(21) Appl. No.: 11/306,441

(22) Filed: Dec. 28, 2005

(65) Prior Publication Data

US 2006/0196402 A1 Sep. 7, 2006

Related U.S. Application Data

(60) Provisional application No. 60/642,555, filed on Jan. 11, 2005, provisional application No. 60/594,301, filed on Mar. 26, 2005, provisional application No. 60/594,770, filed on May 4, 2005.

(51) Int. Cl.
*B63H 9/04* (2006.01)

(52) U.S. Cl. ..... 114/102.16

(58) Field of Classification Search ..... 114/102.1, 114/102.16, 104, 105, 39.13, 39.31
See application file for complete search history.

(56) References Cited

U.S. PATENT DOCUMENTS 4,263,861 A * 4/1981 Vicard ..... 114/39.31
4,506,620 A * 3/1985 Gerr ..... 114/102.16
5,231,943 A * 8/1993 Benze ..... 114/39.13

* cited by examiner

*Primary Examiner*—Lars A. Olson

(57) ABSTRACT

The present invention simplifies sailing providing control of one or more sails with a wheel. The proposed system eliminates the need to control boom-footed sails separately, giving benefits of less gear and rig for short handed sailing. The wheel controlling the sails provides visible and obvious correlation between sails control action and achieved result, much like rudder control.

3 Claims, 1 Drawing Sheet

WHEEL-CONTROLLED SAILS

Existing sail controls employ ropes (sheets) and winches. Each sail is controlled by its own set of means. The access to said means is often from the deck of the boat. There are difficulties related to the said controls:

need presence on the deck;

require whole boat movement for fine sail adjustments (because existing sail controls are not fast and/or sensitive enough);

do not have means to determine maximum sail lift position;

complicated enough to require special training to carry it out.

This invention aims to make sail control much easier. In order to control all sails of a boat with a wheel, these sails should be able to be easily controlled. It's possible to control a sail or sails by means of a wheel if this wheel is connected through some transmission mechanism to some solid member allowing to change the position of said sail or sails. Therefore, connecting said wheel to one of the sails' booms or other solid members, one can control the sail or sails by rotating the wheel. It provides visible and obvious correlation between control action and achieved result, much like rudder control. It allows to feel torque on the wheel. The position of the wheel with maximum torque corresponds to the angle of the sail with the maximum lifting force. Traditional ribbon indicators are a subject to bad visibility at night or in bad weather. The sensing of the force by hand or by electronic or mechanical torque sensors is more reliable. Indicators may be used to tell and record wheel's positions. When left unattended, wheel controlled boom-footed sail will assume the position of the lowest resistance to the wind. That will prevent the sail from acting as capsizing (overturning) force. A holding device may be used to keep the wheel in position until torque increases above the limit of the device. Excessive torque will overpower a holding device, leading to the sail position of the lowest resistance. These properties of the proposed device improve the safety of the boat. It is worth saying that wheel control is better suited for continuous optimization of the angle between the sail (sails) and apparent wind. The working range of the wheel and shaft gear is effective all 360 degrees when an effective range for sheet control is limited by the type of attachment. So, the wheel sail control becomes independent from the control and speed of the boat: when the boat can not be turned to correct the sails' angle due to wave action, oversteering or other, the sails still would be correctly positioned by the independent wheel control. In addition, in order to make control of the sails and the boat more comfortable, the wheel may be installed in the cabin of the boat.

BRIEF DESCRIPTION OF THE DRAWINGS

FIG. 2 also shows a gear box 7 attached to a wheel 6.

DETAILED DESCRIPTION OF THE INVENTION

Figure 1:
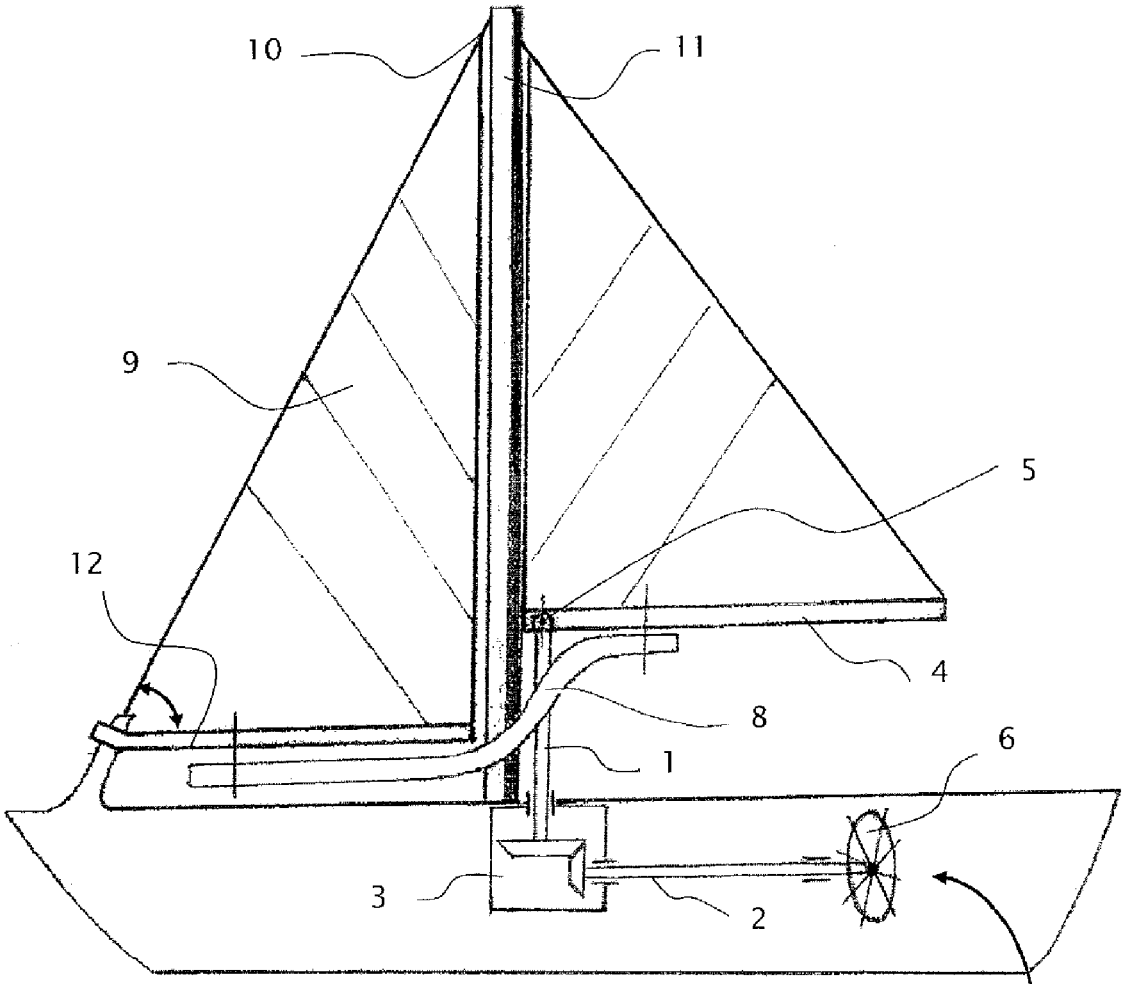
FIG. 1 shows a schematic side view of a sail boat in a sloop sail configuration featuring the invention including rotating shafts 1 and 2.

The proposed apparatus is comprised of at least two shafts 1 & 2 on FIG. 1, connected together at about 90 degrees to each other through gear transmission 3. The other end of the first shaft 1 is attached to the boom 4 of one of the sails, preferably to the biggest one, by means of a fork connection 5. This connection should turn the rotation of the shaft into the boom movement around the axis of its rotation respectfully to the must. The other end of the second shaft 2 is connected to the wheel 6 through an optional gear transmission 7. Both shafts should be fixed stationary by means of bearings, brackets or holders allowing only their rotation movement. The described gear transmissions' rates should be chosen according to the physical dimensions of apparatus' comprising elements. Some indicator should be attached to the rotating mechanism to show the angle position of the controlled sail. Moreover, some tension sensor can be integrated into the proposed apparatus in order to indicate the current lifting force of the sail.

Figure 2:
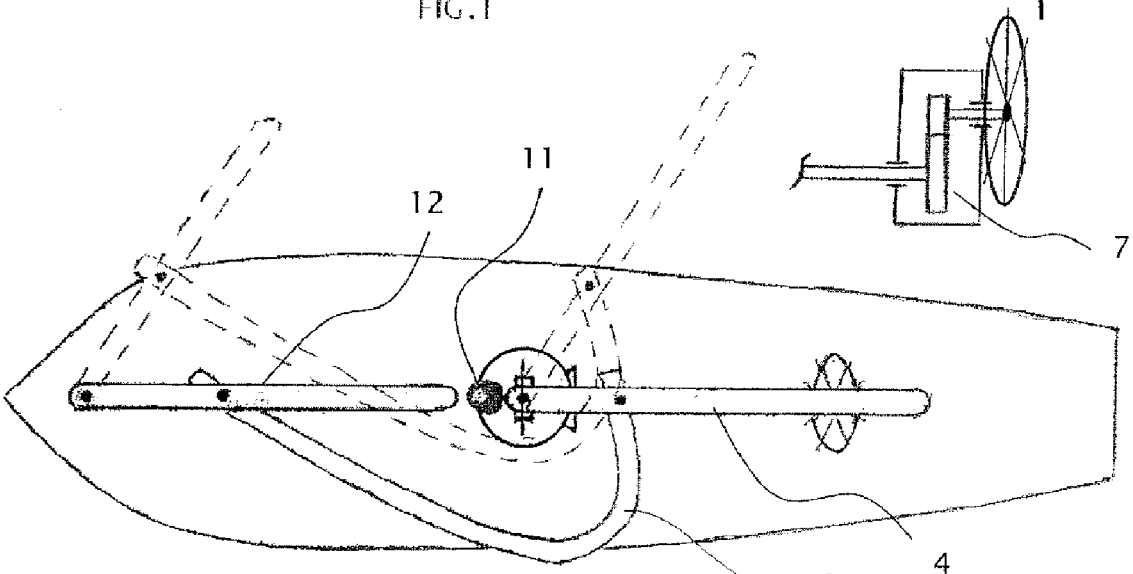
FIG. 2 shows a schematic top view of the same boat as in FIG. 1 in a sloop sail configuration indicating position of booms 4 and 12 and a connecting member 8 in operation.

The proposed system can comprise more than one boom-footed sails and may have one or more connecting members 8 (FIG. 1). The solid connecting member 8 is attached pivotally to the sails' booms. The member 8 is positioned below the booms, therefore allowing the booms to rotate freely while staying connected. Where one boom is mounted higher than the other one the connecting member 8 should have a relative bend or bends allowing a free rotation of booms. The form and the shape of the connecting member 8 should prevent its contact with the must, while the sails rotate. One of the possible shapes of the connecting member 8 is represented on FIG. 2. Consequently, using boom-footed sails on a boat allows to connect their booms together and simultaneously control them, changing position of the booms in the same or any necessary direction. The proposed system eliminates the need to control boom-footed sails separately, giving benefits of less gear and rig for short handed sailing.

The connecting member can be made of solid materials such as metal rode or tube. The joints, where the connecting member is attached to the booms, should allow them to rotate freely. The position of the joints on the booms and/or on the connecting member could be adjustable, providing an easy installation and an ability of adjustment of the relative rate of rotation of the booms. The distance between the boom pivoting points and the connecting member pivoting point to the boom is approximately the same for all connected booms. Changing the distance for one boom we can choose the rate of the rotation for the boom. The invention is suitable for operational range (boom angle range) from −180 to +180 degrees. The maximum turning angle for each boom is unique. One of them usually is less than others. Consequently, the joint boom-footed sails will have the maximum turning angle equal to the smallest one. Due to that, care should be taken, so that the limiting factor (member) is to be strong enough not to be damaged by the combined force of two or more sails applied to it when said maximum angle is reached.

In order to get better control and to improve sailing characteristics of a sailboat, the following construction of the headsail is offered. FIG. 1 shows main detail of the invention. The headsail 9 is essentially a triangular sheet of flexible material having a front edge, a bottom edge and a free edge. The front edge of the headsail 9 is attached to the headstay 10. The top end of the headstay 10 is attached to the mast 11. The low end of the headstay 10 is attached to the deck or to the bowsprit of the sailboat. The bottom edge of the headsail 9 is footed to the boom 12. The front end of the boom 12 is hinged essentially at the location of the low end of the headstay 10 or close to it. The boom 12 is able to rotate around the headstay 10 on angles not less than 90 degrees measured between the longitudinal axis of the sailboat and the boom 12. The axis of the boom 12 rotation is essentially coincided with the headstay 10 or parallel to the headstay 10 direction. The angle between the boom 12 and the headstay 10 is essentially constant during the boom 12 rotation around the headstay 10. Preferably no other headstay is present to abstract the rotation of the headsail. Preferably the headsail boom covers all the distance to the mast without touching it. Preferably the headsail boom is attached high enough to provide free rotation of the headsail. Preferably the headstay and the boom are both attached at the same location. Preferably the hinge for the boom has means to control the angle between the headstay and the boom. The invention improves aerodynamic form of the headsail, by keeping the headsail flat, especially at large angles. The boom control of the headsail makes its handling easier and more precise.

What is claimed is:

1. An apparatus consisting of:

a boom-footed sail, where the boom is able to rotate around its end;

a rotating shaft;

power assisted transmission means conveying the rotation of the shaft to the rotation of the boom.

2. An apparatus consisting of:

a boom-footed sail, where the boom is able to rotate around its end;

a rotating shaft;

transmission means conveying the rotation of the shaft to the rotation of the boom;

an indicator and/or sensor of the position of the shaft.

3. An apparatus consisting of:

a boom-footed sail, where the boom is able to rotate around its end;

a rotating shaft;

transmission means conveying the rotation of the shaft to the rotation of the boom;

an indicator and/or sensor of torque applied to the shaft.

* * * * *